US012510287B2

(12) United States Patent
Bollinger et al.

(10) Patent No.: US 12,510,287 B2
(45) Date of Patent: Dec. 30, 2025

(54) UNIFORM TEMPERATURE DISTRIBUTION SYSTEMS AND TRAYS

(71) Applicant: Cryoport, Inc., Brentwood, TN (US)

(72) Inventors: Bret Bollinger, Yorba Linda, CA (US); Ben Lee, Corona, CA (US)

(73) Assignee: Cryoport, Inc., Brentwood, TN (US)

( * ) Notice: Subject to any disclaimer, the term of this patent is extended or adjusted under 35 U.S.C. 154(b) by 275 days.

(21) Appl. No.: 18/080,593

(22) Filed: Dec. 13, 2022

(65) Prior Publication Data

US 2024/0191928 A1 Jun. 13, 2024

(51) Int. Cl.

| | |
|---|---|
| ***B65D 1/36*** | (2006.01) |
| ***B65D 21/02*** | (2006.01) |
| ***B65D 21/08*** | (2006.01) |
| ***B65D 81/18*** | (2006.01) |
| ***F25D 3/08*** | (2006.01) |

(52) U.S. Cl.

CPC ..... *F25D 3/08* (2013.01); *B65D 1/36* (2013.01); *B65D 21/0209* (2013.01); *B65D 21/086* (2013.01); *B65D 81/18* (2013.01)

(58) Field of Classification Search

CPC .... F25D 3/08; F25D 3/06; B65D 1/36; B65D 1/34; B65D 81/3813; B65D 81/3818; B65D 81/382; B65D 81/18; B65D 21/0209; B65D 21/086; B65D 88/74; B65D 88/741; B65D 88/744; B65D 2588/74; B65D 2519/00308

See application file for complete search history.

(56) References Cited

U.S. PATENT DOCUMENTS

| | | | | |
|---|---|---|---|---|
| 2016/0362240 | A1* | 12/2016 | Ferracamo, Jr. ..... | A61J 1/165 |
| 2017/0082344 | A1 | 3/2017 | Tansley | |
| 2017/0305632 | A1* | 10/2017 | Brown ..... | F25D 3/08 |
| 2018/0335241 | A1* | 11/2018 | Li ..... | B65D 25/06 |
| 2019/0226744 | A1 | 7/2019 | Wood et al. | |

FOREIGN PATENT DOCUMENTS

| | | | |
|---|---|---|---|
| CN | 210028501 | U | 2/2020 |
| JP | 08-051888 | A | 2/1996 |
| JP | 2010-216701 | A | 9/2010 |
| JP | 2019-0647708 | A | 4/2019 |

OTHER PUBLICATIONS

English translation of Kano et al. (JP 08051888 A). (Year: 1996).*

PCT; International Search Report & Written Opinion dated Mar. 25, 2024 in PCT Application No. PCT/US2023/080965.

PCT; International Preliminary Report on Patentability (IPRP) dated Jun. 26, 2025 in PCT Application No. PCT/US2023/080965.

* cited by examiner

*Primary Examiner* — Miguel A Diaz

(74) *Attorney, Agent, or Firm* — Snell & Wilmer L.L.P.

(57) ABSTRACT

Devices, systems, and methods of trays for uniformly cooling a payload are provided. A tray includes a body. The body includes an internal wall, a plurality of side panels in connection with the internal wall panel and a plurality of dividers in connection with the internal wall panel and one or more of the plurality of side panels. The plurality of dividers may define a plurality of chambers, each chamber of the plurality of chambers at least partially bounded by a divider of the plurality of dividers and/or (ii) the internal wall panel. Each chamber of the plurality of chambers is configured to receive a portion of a cooling agent inserted into the body. A cover panel attached to the body.

30 Claims, 8 Drawing Sheets

UNIFORM TEMPERATURE DISTRIBUTION SYSTEMS AND TRAYS

BACKGROUND

1. Field

This specification relates to temperature regulation systems and devices, particularly systems and devices for uniform temperature regulation in modular shipping containers.

2. Description of the Related Art

In the health, medical, pharmaceutical, and/or life science industries, safe storage and fast transportation of payloads in a temperature-controlled and watertight environments is important. Hardened reusable shipping containers that maintain, regulate, or control the payload area temperature are desirable in transporting temperature sensitive payload in such industries. The payload area temperature may be maintained by using phase change materials (e.g., dry ice). Generally, dry ice is disposed over, under, and/or on the sides of a payload using trays that contain the dry ice. However, temperature inside the payload area may not be uniform with such a configuration. Instead, temperature may be warm over the payload and cold under the payload due to the dry ice sublimating and traveling down to the bottom of the payload area where the payload sits on dry ice.

As such, there is a need for systems and devices to provide uniform temperature distribution inside the payload area and to increase cooling capacity.

SUMMARY

In general, one aspect of the subject matter described in this specification is embodied in a tray for uniformly cooling a payload. The tray may have a body. The body may have an internal wall panel, and a plurality of side panels in connection with the internal wall panel, and a plurality of dividers. The dividers may be in connection with the internal wall panel and one or more of the plurality of side panels. The plurality of dividers may define a plurality of chambers, each chamber of the plurality of chambers is at least partially bounded by (i) at least one divider of the plurality of dividers, (ii) the internal wall panel. Each chamber of the plurality of chambers may be configured to receive a portion of a cooling agent inserted into the body. A cover panel may be attached to the body.

This and other embodiments may optionally include the plurality of side panels comprising one or more tabs. The cover panel may be configured to attached to the body by the one or more tabs on the side panels. The internal wall panel may comprise a plurality of holes. A fastener may be attached to the body to couple the tray to a second tray. The body of the tray may have a trapezoidal shape. The cooling agent may be dry ice, or any other solid cooling agent, gel cooling agent, cryogen, or the like.

The dividers may define four or more chambers of the plurality of chambers in the body of the tray. The cooling agent may be disposed inside each chamber of the plurality of chambers of the body of the tray.

In another aspect, the subject matter may be embodied by a tray system for uniformly cooling a payload. The tray system may comprise a plurality of trays. Each tray of the plurality of trays may comprise an internal wall panel, a plurality of side panels in connection with the internal wall panel, a plurality of dividers in connection with the internal wall panel and one or more of the plurality of side panels, and a cover panel attached to the plurality of side panels. The dividers may define two or more chambers configured to receive a cooling agent inserted in each of the chambers In this and various embodiments, the plurality of trays may be configured to enclose a payload from six sides. The cover panel may be attached to the plurality of side panels by one or more tabs. Each of the plurality of trays may have a trapezoidal shape for the plurality of panels to fit together to form a box. Each of the plurality of trays are attachable to one another by fastener.

The plurality of trays may be stackable on top of each other for storage. The tray system may further comprise a band configured to wrap around and bundle the plurality of trays.

In another aspect the subject matter may be a system for shipping a uniformly cooled payload. The system may include an outer enclosure and an inner enclosure. The outer enclosure may have a cavity. The inner enclosure may be positioned within the cavity of the outer enclosure comprising a plurality of trays. The plurality of trays of the inner enclosure define a payload area. The plurality of trays may comprise a plurality of dividers and a cooling agent separated by the dividers.

In this and various embodiments, the plurality of trays may further include an internal wall panel in connection with the dividers, a plurality of side panels in connection with the internal wall panel. The plurality of side panels may be angled so that the plurality of trays are trapezoidal shaped and each of the plurality of trays are configured to connect to form a box. The plurality of trays may include a top tray, a plurality of side trays and a bottom tray that is opposite the top tray. The plurality of side panels of the top tray may interface with a side panel of each of the plurality of side trays. The plurality of side panels of the bottom tray may interface with a side panel of each of the plurality of side trays. The side panels of the plurality of side trays may interface with each other. The outer enclosure may include a base and a lid, wherein the lid is removable to access the inner enclosure when the inner enclosure is within the cavity of the outer enclosure. Each of the plurality of trays may be attachable to one another by a fastener.

A method is also disclosed. The method may be for maintaining temperature of a payload area of a shipping container. The method may include inserting a cooling agent into a plurality of trays, wherein the trays comprise dividers to disperse the cooling agent. The method may include attaching a cover panel to each of the plurality of trays. The method may include connecting the plurality of trays to form an inner enclosure, the inner enclosure defining the payload area.

In various embodiments, the method may include receiving a payload by the payload area of the inner enclosure. The method may include cooling the payload area by the cooling agent to maintain the payload area within a predetermined temperature range. The method may include placing the inner enclosure into a cavity of an outer enclosure, the outer enclosure having a plurality of side panels and a base defining the cavity in the outer enclosure. The method may include attaching a lid on a top of the outer enclosure to cover the cavity of the outer enclosure containing the inner enclosure. The method may include stabilizing the payload by the plurality of trays of the inner enclosure. The predetermined temperature range may be between about 25 degrees Celsius to about −80 degrees Celsius. The method may include wherein each of the plurality of trays are configured to connect to each other by a plurality of side walls.

BRIEF DESCRIPTION OF THE DRAWINGS

Other systems, methods, features, and advantages of the present disclosure will be apparent to one skilled in the art upon examination of the following figures and detailed description. Component parts shown in the drawings are not necessarily to scale and may be exaggerated to better illustrate the important features of the present disclosure.

DETAILED DESCRIPTION

Disclosed herein are uniform temperature distribution systems and trays. The systems and trays may include or be used in conjunction with modular shipping containers configured to be temperature regulated with a cooling agent such as dry ice or another phase change material (PCM). The trays may be disposed around a payload of a shipping container from within a payload area situated in a base enclosure of the shipping container. The trays may enclose the payload from all six sides such as to create a box or box-like structure. The trays may each have a housing that is internally segmented. For instance, the housing may be divided into chambers or pockets on top of one another. Each chamber may be packed with a cooling agent such as dry ice. The internally segmented arrangement of the chambers may prevent the dry ice from sinking to the bottom of the payload once sublimated. Instead, the dry ice is trapped within the confinements of each of the chambers, and thus may provide uniform temperature distribution within the shipper and increase the cooling capacity of the shipper.

Other benefits and advantages include the trays being attachable to each other or foldable or stackable. For instance, the trays may each have a trapezoidal shape that enables easy joining of the trays. The trays may also be stacked on top of each other when not in use to be stored.

Figure 1:
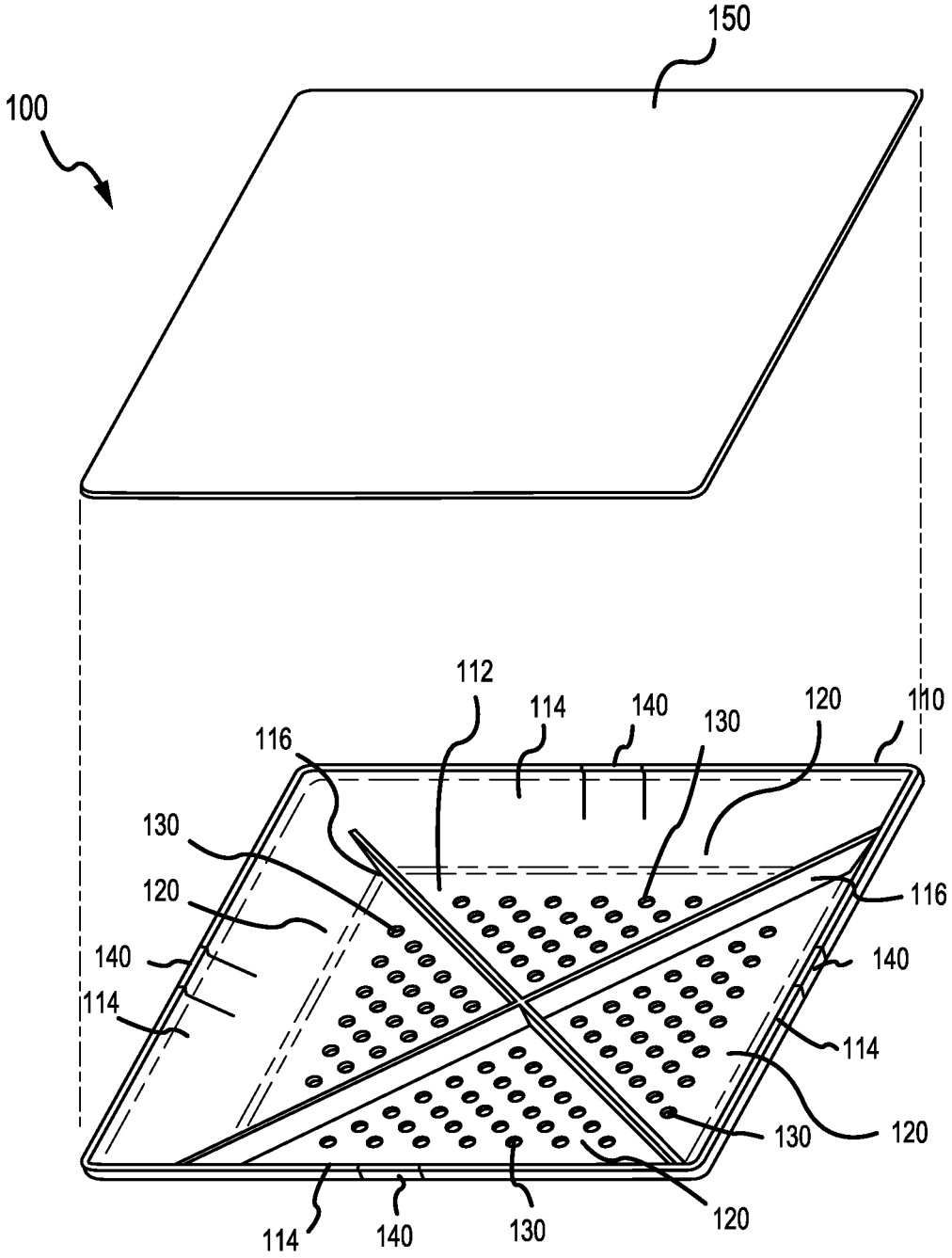
FIG. 1 shows an example of a tray for uniformly cooling a payload according to an aspect of the invention.

In various aspects of the invention, FIG. 1 shows a tray 100 for uniformly cooling a payload. The tray 100 may comprise a body 110. In various embodiments, a body 110 may comprise an internal wall panel 112, a plurality of side panels 114, and a plurality of dividers 116. The plurality of side panels 114 may be in connection with the internal wall panel 112. In various embodiments, the internal wall panel 112 may be shaped like a square and four side panels 114 extend from each side of the internal wall panel 112. In various embodiments, the body 110 may have a trapezoidal shape. For example, the side panels 114 may extend at an angle from the internal wall panel 112 to make a trapezoidal prism shape.

In various embodiments, the dividers 116 may be in connection with the internal wall panel 112. In various embodiments, the dividers 116 may be in connection with one or more of the side panels 114. In various embodiments, the dividers 116 may define a plurality of chambers 120.

In various embodiments, the plurality of chambers 120 may be partially bounded by at least one divider 116 and the internal wall panel 112. In various embodiments, each of the plurality of chambers 120 may be configured to receive a cooling agent. In various embodiments, there may be four or more chambers 120. The chambers 120 may be arranged so that they divide the body 110 into four quadrants. The plurality of chambers 120 may be disposed within the body 110 to receive a portion of a cooling agent.

In various embodiments, the internal wall panel 112 may include a plurality of holes 130. The plurality of holes 130 may cover some or all of the internal wall panel 112. The plurality of holes 130 may be arranged to allow the cooling agent to release cool gas or vapor from the base of the body 110 through the internal wall panel 112.

In various embodiments, the tray 100 is configured to receive a cooling agent. The cooling agent may be dry ice or shredded dry ice. The cooling agent may be inserted into each of the plurality of chambers 120. For example, the cooling agent may be packed into the plurality of chambers 120. The tray 100 may be configured to provide temperature dispersion.

In various embodiments, the tray 100 may comprise a cover panel 150. The cover panel 150 may attach to the body 110. The cover panel 150, when attached to the body 110, may enclose the body 110. For example, the cover panel 150 may close the body 110 to prevent the cooling agent from releasing from the tray 100.

In various embodiments, the body 110 may include one or more tabs 140. In various embodiments, the plurality of side panels 114 may comprise a tab 140. The body 110 may also be configured to receive a cover panel 150. In various embodiments, the tab 140 may be configured to latch or connect to the cover panel 150. The tab 140 may hold the cover panel 150 in place. The cover panel 150 may be removed from the body 110 by pressing the one or more tabs 140.

Figure 2:
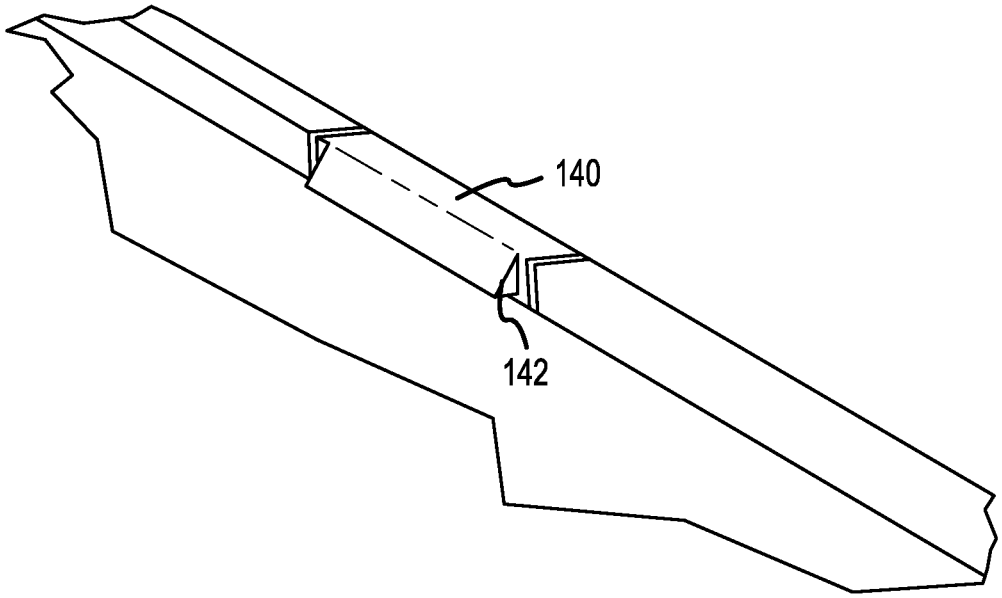
FIG. 2 shows an example of a tab on the tray according to an aspect of the invention.

In various embodiments, as shown in FIG. 2 and with continued reference to FIG. 1, the tab 140 may attach to the cover panel 150 to the body 110. The tab 140 may have a tab protrusion 142. The tab protrusion 142 may attach to the cover panel 150 to hold the cover panel 150 to the body 110.

Figure 3:
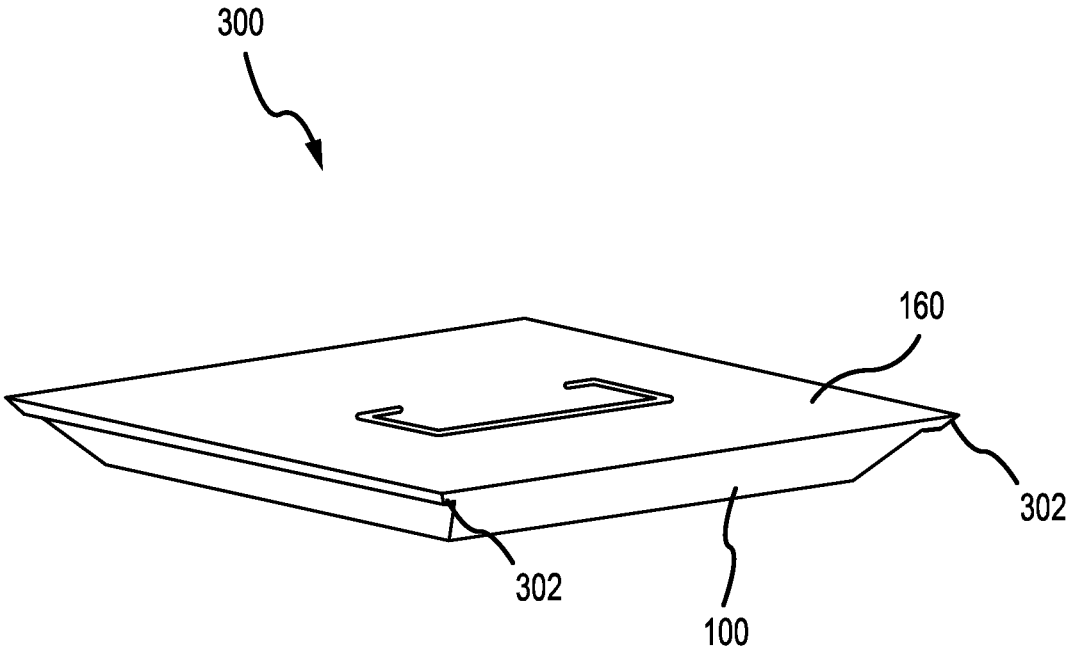
FIG. 3 shows a view of a tray with an attached cover panel according to an aspect of the invention.

In various embodiments, as shown by FIG. 3, the tray 300 may include a cover panel 160. In various embodiments, the cover panel 160 may be slidably attached to the tray 100. For example, the tray 100 may be slid into the channel portion 302 of the cover panel 160 to attach the tray 100 to the cover panel 160.

In various embodiments, a cover panel 160 may enclose the body 110 by slidable connecting to the body 110. For example, the edges of the body 110 may be slid into the channel 302 to position the body 110 within the channel 302, to enclose the body 110.

Figure 4A:
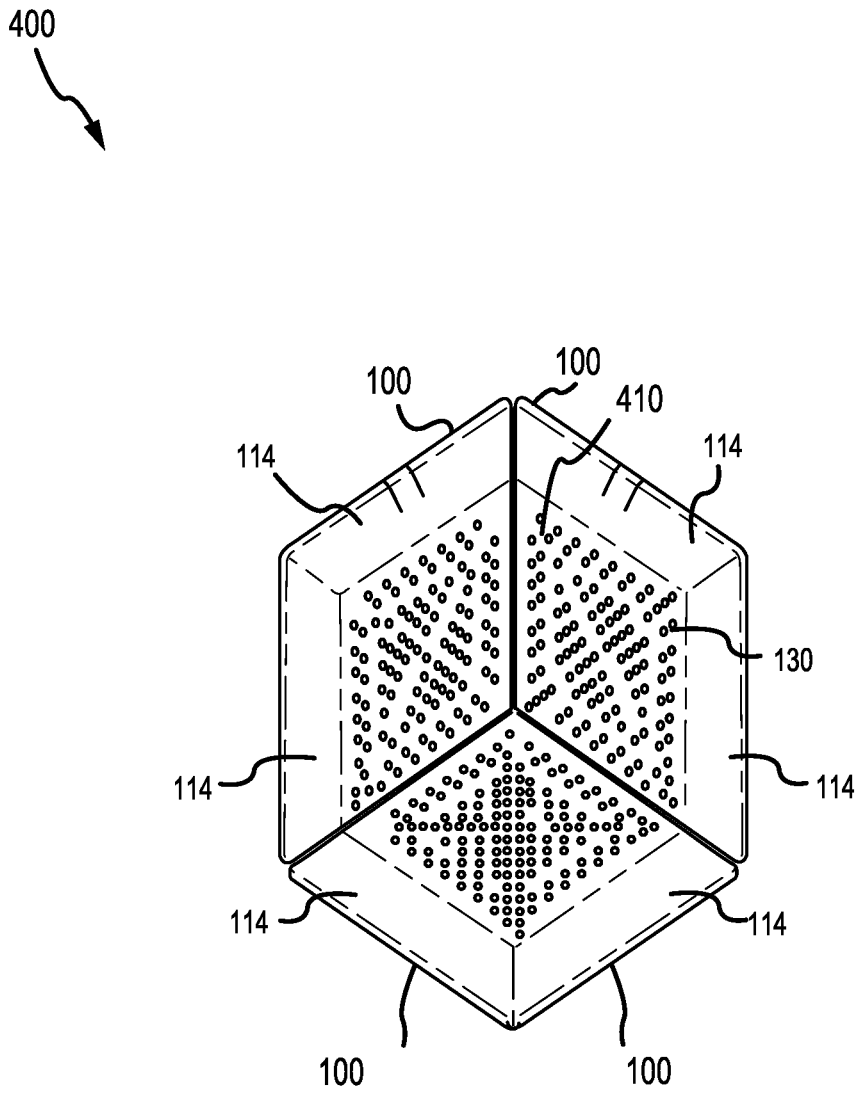
FIG. 4A shows an example of multiple trays connected according to an aspect of the invention.
Figure 4B:
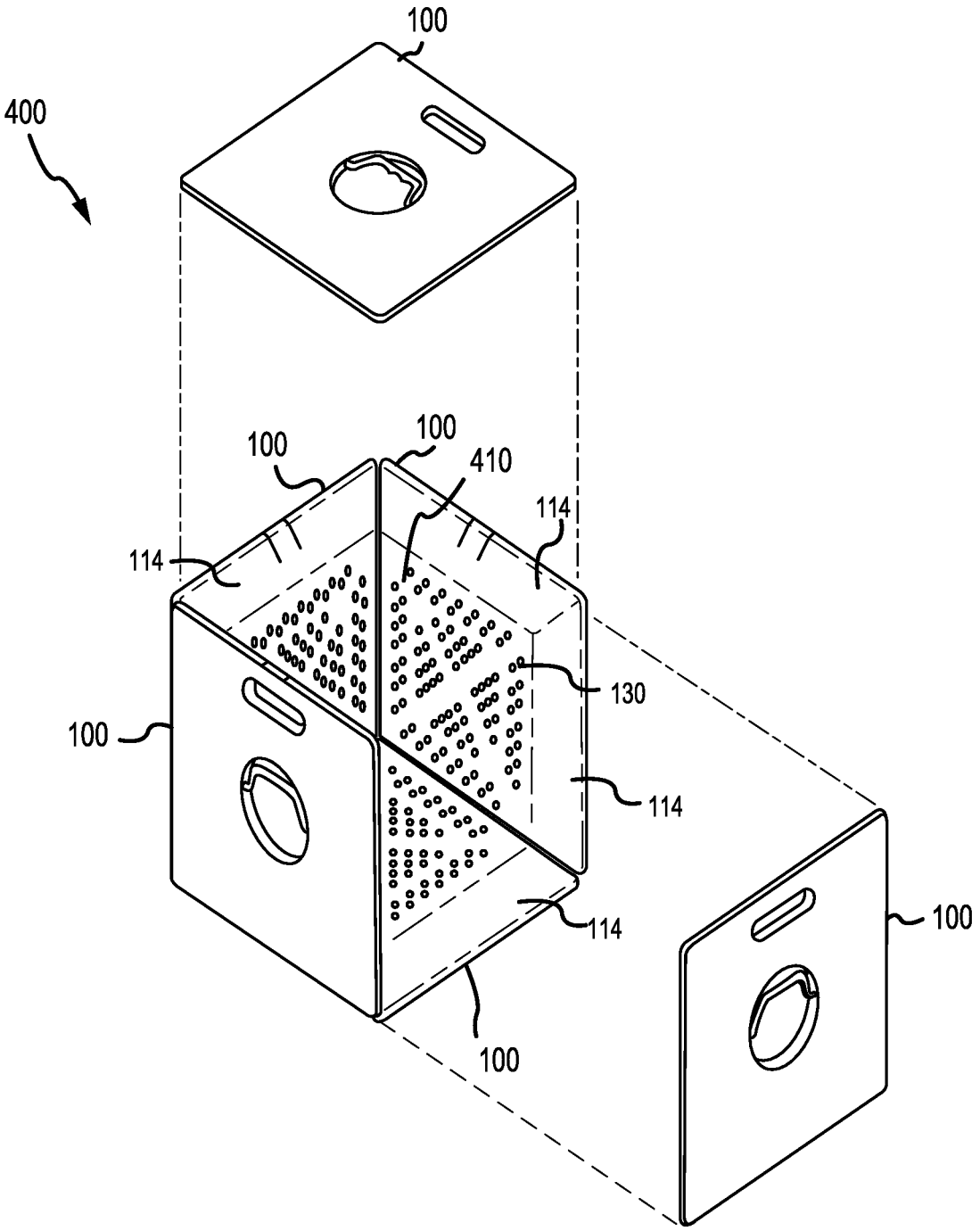
FIG. 4B shows an example of multiple trays connected to create a box according to an aspect of the invention.

In various embodiments, as shown in FIGS. 4A and 4B, and continued reference to FIGS. 1-3, a tray system 400 may comprise a plurality of trays 100. In various embodiments, each of the plurality of trays 100 may fit together to form a box. In various embodiments, the side panels 114 of each of the plurality of trays 100 may be configured to fit together and form a box. In various embodiments, the each of the plurality of trays 100 may have a trapezoidal shape for the plurality of panels to fit together to form a box. For example, the side panels 114 may extend at a 45 degree angle from the cross axis of the internal wall panel 112. Thereby, the side panels 114 of each tray 100 complement each other to form a box. In various embodiments, the plurality of trays 100 may be configured to enclose a payload from six sides. For example, in various embodiments the plurality of trays 100 may define a payload area 410. The payload area 410 may be configured to receive a payload. In various embodiments, the trays 100 may connect to each other by a fastener. A fastener may be used to couple a tray 100 to a second tray 100.

In various embodiments, with reference to FIGS. 4A and 4B, the tray system 400 may comprise a plurality of trays 100, including a top tray, a plurality of side trays, and a bottom tray that is opposite the top tray. The plurality of side panels 114 of the top tray may interface with a side panel 114 of each of the plurality of side trays. The plurality of side panels 114 of the bottom tray may interface with a side panel 114 of each of the plurality of side trays. The side panels 114 of the plurality of side trays interface with each other.

Figure 5:
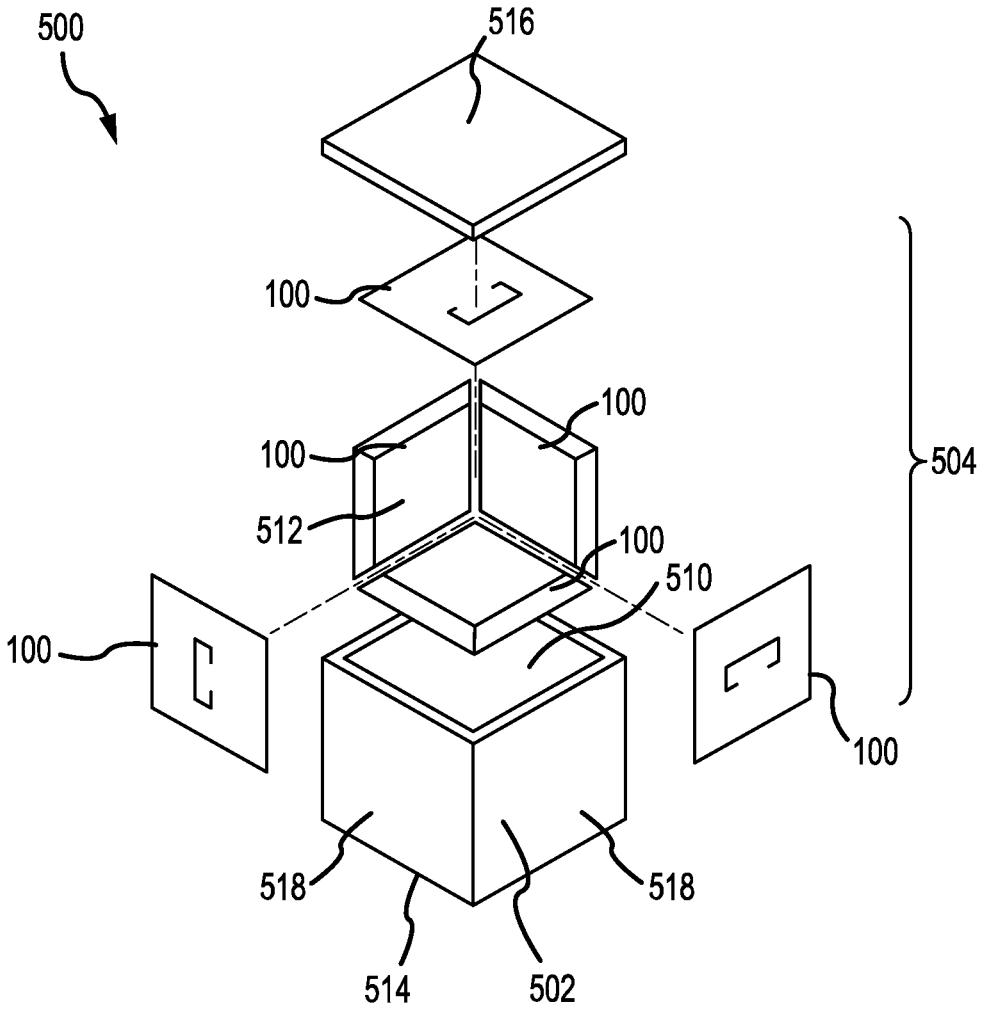
FIG. 5 shows an example of a shipping container that has multiple panels or trays according to an aspect of the invention.

FIG. 5 shows an exploded view of a shipper 500. The shipper 500 maintains a temperature controlled environment for a payload within a payload area 512. The shipper 500 may include an outer enclosure 502 and an inner enclosure 504. The outer enclosure 502 may have a cavity 510. The outer enclosure 502 may be trapezoidal. For instance, the outer enclosure 502 may be rectangular. In further instances, the outer enclosure 502 may be cubic. The outer enclosure 502 may be a cube comprising a base 514, a removable lid 516, and multiple sidewalls 518. The lid 516 may be removable to access the inner enclosure 504 when the inner enclosure 504 is within the cavity 510 of the outer enclosure 502. Moreover, the outer enclosure 502 may be made from an insulative, metallic or a nonmetallic material, such as a polycarbonate or other polymer. The outer enclosure 502 may be designed withstand shocks and vibrations at cryogenic temperatures that occur during transport and/or storage.

In various embodiments, the base 514, the lid 516 and/or the multiple sidewalls 518 may form or define the cavity 510 that receives the inner enclosure 504 within the cavity 510. The lid 516 may be removable to allow access to the inner enclosure 504. The lid 516 may couple to the multiple sidewalls 518 via one or more hinges, latches and/or connectors and/or may be sized and shaped to fit to rest on the multiple sidewalls 518 to enclose and/or surround the cavity 510. This allows the lid 516 to be removable and/or to be moved between an open position and a closed position to provide access to the cavity 510 and the contents within the cavity 510.

The inner enclosure 504 and the payload may be placed within the cavity 510. The lid 516 may be placed on top of the inner enclosure 504 to prevent access to and seal or partially seal the inner enclosure 504 and/or the payload within the cavity 510. Thus, the outer enclosure 502 may protect the inner enclosure 504 and the payload that is placed within the cavity 510 from shocks and/or vibrations during storage and transport.

In various embodiments, the shipper 500 includes the inner enclosure 504. The inner enclosure 504 may be positioned within the cavity 510 of the outer enclosure 502. The inner enclosure 504 may comprise a plurality of trays 100. The inner enclosure 504 may be configured to provide temperature dispersion. The plurality of trays 100 may be positioned along and/or adjacent to the inner surface of the base 514, the multiple sidewalls 518, and/or the lid 516 within the cavity 510. The plurality of trays 100 may define a payload area 512 that may receive and enclose a payload that is placed within the payload area 512. In various embodiments, the inner enclosure 504 may comprise plurality of trays 100, including a top tray, a plurality of side trays, and a bottom tray that is opposite the top tray.

Figure 6:
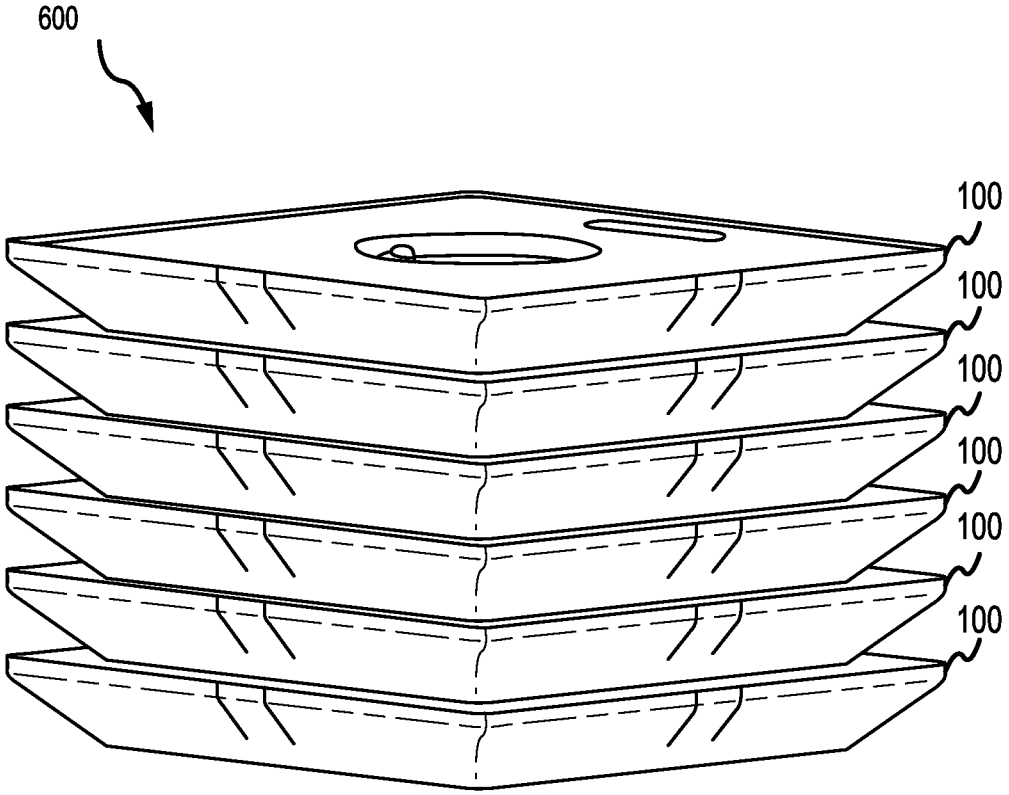
FIG. 6 shows an example of stackable trays according to an aspect of the invention.

In various embodiments, as shown in FIG. 6, a stackable tray system 600 may comprise a plurality of trays 100. The plurality of trays 100 may be configured to stack on top of each other for storage. The stackable tray system 600 may be bundled together with a band or other device to connect the plurality of trays 100.

Figure 7:
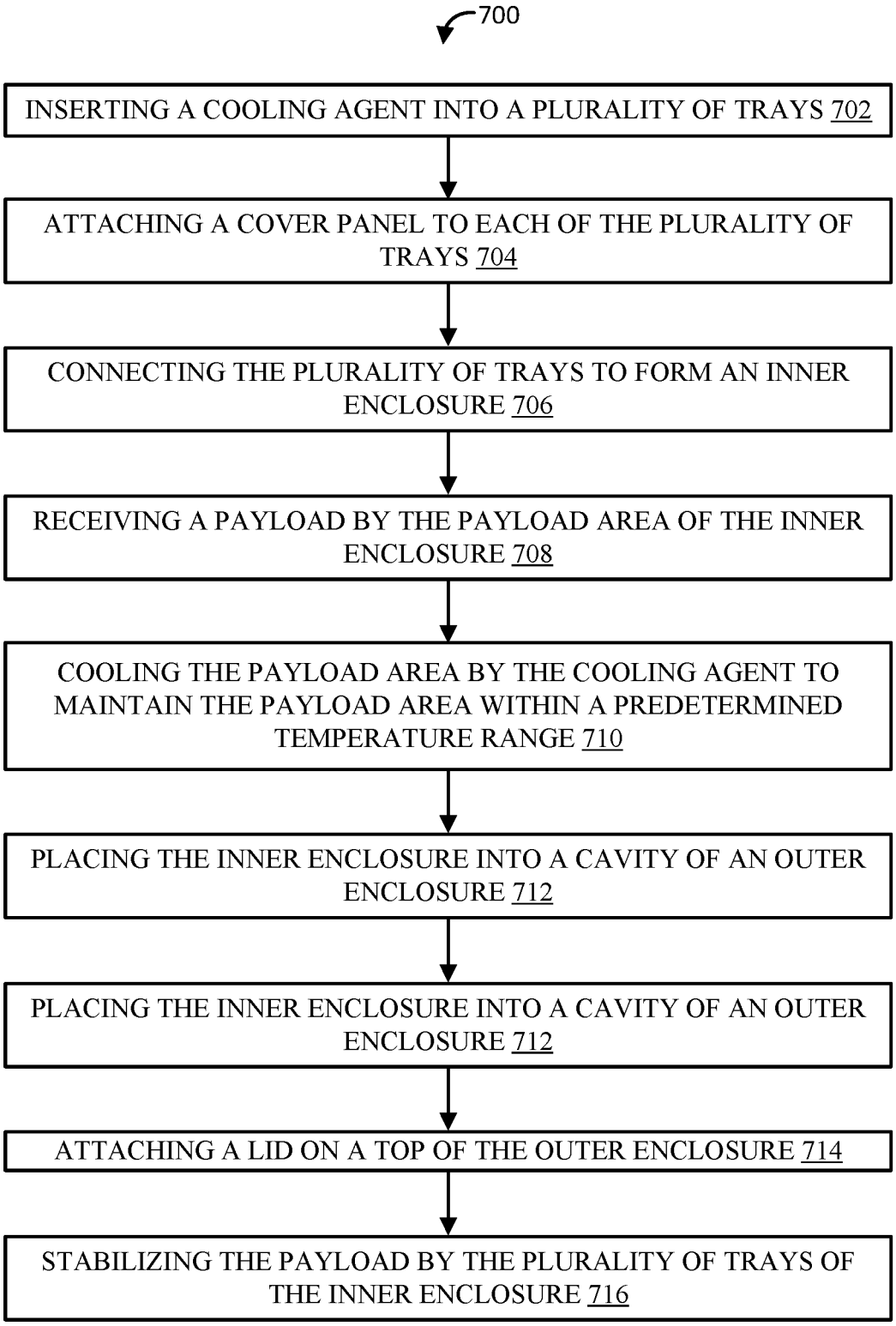
FIG. 7 shows a method for maintaining temperature of a payload area of a shipping container according to an aspect of the invention.

With reference now to FIG. 7, a method 700 is provided. The method 700 may be for maintaining temperature of a payload area of a shipping container. The method 700 may include inserting a cooling agent into a plurality of trays (block 702). The trays may comprise dividers to disperse the cooling agent. The method 700 may include attaching a cover panel to each of the plurality of trays (block 704). The method of 700 may include connecting the plurality of trays to form an inner enclosure (block 706). In various instances, the inner enclosure may define the payload area.

The method 700 may include receiving a payload by the payload area of the inner enclosure (block 708). The method 700 may include cooling the payload area by the cooling agent to maintain the payload area within a predetermined temperature range (block 710). The method 700 may include placing the inner enclosure into a cavity of an outer enclosure (block 712). In various embodiments, the outer enclosure may have a plurality of side panels and a base defining the cavity in the outer enclosure. The method 700 may include attaching a lid on a top of the outer enclosure (block 714). In various embodiments, the attaching the lid to the top of the outer enclosure may cover the cavity of the outer enclosure containing the inner enclosure. The method 700 may include stabilizing the payload by the plurality of trays of the inner enclosure (block 716).

In connection with the method 700, various aspects and different embodiments may be incorporated. For example, the predetermined temperature range may be below 0 degrees Celsius. The predetermined temperature range may be below about 0 degrees Celsius. The predetermined temperature range may be between 25 degrees Celsius to −80 degrees Celsius. The predetermined temperature range may be between about 25 degrees Celsius to about −80 degrees Celsius. The predetermined temperature range may be between −150 degrees Celsius to −190 degrees Celsius. The predetermined temperature range may be between about −150 degrees Celsius to about −190 degrees Celsius. The predetermined temperature range may be below about −150 degrees Celsius. The predetermined temperature range may be below −150 degrees Celsius. The inner enclosure may have a plurality of trays, the plurality of trays defining the payload area. A payload may be inserted into the payload area, wherein the payload is stabilized by the plurality of trays of the inner enclosure. Each of the plurality of trays are configured to connect to each other by a plurality of side walls.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A tray for uniformly cooling a payload comprising:

a body comprising:

an internal wall panel comprising a planar panel;

a plurality of four side panels in connection with the internal wall panel and each side panel of the four side panels extending at an angle from the internal wall panel, each of the side panel connected at opposite edges to another of the side panels so that each of the side panels is connected to two other of the side panels, wherein a combination of the internal wall panel and the four side panels are a trapezoidal prism shape; and a plurality of dividers in connection with the internal wall panel and one or more of the plurality of side panels, wherein the plurality of dividers define a plurality of chambers, each chamber of the plurality of chambers at least partially bounded by at least one divider of the plurality of dividers and the internal wall panel, wherein each chamber of the plurality of chambers is configured to receive a portion of a cooling agent inserted into the body, and wherein the body is configured to attach to a cover panel parallel to and spaced apart from the internal wall panel to at least partially cover the each chamber of the plurality of chambers so that each chamber is bounded by at least one divider, the internal wall panel, and the cover panel.

2. The tray of claim 1, further comprising the cover panel attached to the body parallel to and spaced apart from the internal wall panel.

3. The tray of claim 2, wherein the plurality of side panels comprise one or more tabs, wherein the cover panel is configured to attach to the body by the one or more tabs on the side panels.

4. The tray of claim 1, wherein the internal wall panel comprises a plurality of holes defined through the internal wall panel and each of the plurality of holes provides fluid communication into at least one chamber of the plurality of chambers.

5. The tray of claim 1, further comprising a fastener attached to the body to couple the tray to a second tray.

6. The tray of claim 1, wherein the cooling agent is dry ice.

7. The tray of claim 1, wherein the plurality of dividers define four or more chambers of the plurality of chambers in the body of the tray.

8. The tray of claim 7, further comprising the cooling agent disposed inside each chamber of the plurality of chambers of the body of the tray.

9. A tray system for uniformly cooling a payload comprising:

a plurality of trays, each tray of the plurality of trays comprising:

a body, the body comprising:

an internal wall panel;

a plurality of four side panels in connection with the internal wall panel and each side panel of the four side panels extending at an angle from the internal wall panel, each of the side panel connected at opposite edges to another of the side panels so that each of the side panels is connected to two other of the side panels; and a plurality of dividers in connection with the internal wall panel and one or more of the plurality of side panels, wherein the plurality of dividers define two or more chambers configured to receive a cooling agent inserted in each of the chambers.

10. The tray system of claim 9, wherein each tray of the plurality of trays further comprises a cover panel attached to the plurality of side panels.

11. The tray system of claim 9, wherein the plurality of trays are arranged to enclose the payload from six sides.

12. The tray system of claim 10, wherein at least one side panel of the plurality of side panels comprises one or more tabs, wherein the cover panel is configured to attach to the body by the one or more tabs on the side panels.

13. The tray system of claim 9, wherein the each of the plurality of trays has the trapezoidal prism shape for the plurality of trays to fit together to form a box.

14. The tray system of claim 9, wherein each of the plurality of trays are attachable to one another by one or more fasteners.

15. The tray system of claim 9, wherein the plurality of trays are stackable on top of each other for storage.

16. The tray system of claim 15, further comprising a band configured to wrap around and bundle the plurality of trays.

17. The tray system of claim 9, wherein the cooling agent is dry ice.

18. A system for shipping a uniformly cooled payload comprising:

an outer enclosure having a cavity;

an inner enclosure positioned within the cavity of the outer enclosure, the inner enclosure comprising a plurality of trays, wherein the plurality of trays of the inner enclosure define a payload area, and wherein each tray of the plurality of trays comprises an internal wall panel, a plurality of side panels in connection with the internal wall panel, each of the plurality of four side panels connected at opposite edges to another of the side panels so that each of the side panels is connected to two other of the side panels, and a plurality of dividers defining compartments and separated by the plurality of dividers to receive a cooling agent.

19. The system of claim 18, wherein each of the plurality of trays are configured to connect to form a box.

20. The system of claim 19, wherein the plurality of trays further comprise:

a top tray;

a plurality of side trays; and a bottom tray that is opposite the top tray, wherein the plurality of side panels of the top tray interface with a side panel of each of the plurality of side trays, wherein the plurality of side panels of the bottom tray interface with a side panel of each of the plurality of side trays, and wherein the side panels of the plurality of side trays interface with each other.

21. The system of claim 18, wherein the outer enclosure includes a base and a lid, wherein the lid is removable to access the inner enclosure when the inner enclosure is within the cavity of the outer enclosure.

22. The system of claim 18, wherein each of the plurality of trays are attachable to one another by a fastener.

23. A method for maintaining temperature of a payload area of a shipping container comprising:

inserting a cooling agent into a plurality of trays, wherein each tray of the plurality of trays comprises dividers to disperse the cooling agent;

attaching a cover panel to each of the plurality of trays; and connecting the plurality of trays to form an inner enclosure, wherein the inner enclosure defines the payload area, wherein each tray of the plurality of trays further comprises:

a body comprising:

an internal wall panel comprising a planar panel;

a plurality of four side panels in connection with the internal wall panel and each side panel of the four side panels extending at an angle from the internal wall panel, each of the side panel connected at opposite edges to another of the side panels so that each of the side panels is connected to two other of the side panels; and wherein the dividers are in connection with the internal wall panel and one or more of the plurality of side panels.

24. The method of claim 23, further comprising:

receiving a payload by the payload area of the inner enclosure.

25. The method of claim 24, further comprising:

cooling the payload area by the cooling agent to maintain the payload area within a predetermined temperature range.

26. The method of claim 25, further comprising:

placing the inner enclosure into a cavity of an outer enclosure, the outer enclosure having a plurality of side panels and a base defining the cavity in the outer enclosure.

27. The method of claim 26, further comprising:

attaching a lid on a top of the outer enclosure to cover the cavity of the outer enclosure containing the inner enclosure.

28. The method according to claim 27, further comprising:

stabilizing the payload by the plurality of trays of the inner enclosure.

29. The method according to claim 25, wherein the predetermined temperature range is between about 25 degrees Celsius to about −80 degrees Celsius.

30. The method according to claim 23, wherein each of the plurality of trays is configured to connect to each other by a plurality of side walls.

* * * * *